United States Patent [19]

Imhof et al.

[11] Patent Number: 4,627,405

[45] Date of Patent: Dec. 9, 1986

[54] APPARATUS FOR INJECTING FUEL INTO COMBUSTION CHAMBERS

[75] Inventors: Ernst Imhof, Münchingen; Iwan Komaroff, Regensburg; Gunther Schmid, Stuttgart; Werner Grunwald, Gerlingen; Helmut Reum, Stuttgart, all of Fed. Rep. of Germany

[73] Assignee: Robert Bosch GmbH, Stuttgart, Fed. Rep. of Germany

[21] Appl. No.: 699,977

[22] PCT Filed: Mar. 30, 1984

[86] PCT No.: PCT/DE84/00073

§ 371 Date: Jan. 14, 1985

§ 102(e) Date: Jan. 14, 1985

[87] PCT Pub. No.: WO84/04567

PCT Pub. Date: Nov. 22, 1984

[30] Foreign Application Priority Data

May 13, 1983 [DE] Fed. Rep. of Germany ..... 3317503
Aug. 2, 1983 [DE] Fed. Rep. of Germany ..... 3327773

[51] Int. Cl.[4] ..... B05B 1/24; F02M 23/14; F02M 31/02

[52] U.S. Cl. ..... 123/549; 123/179 H; 123/298; 123/556; 239/133

[58] Field of Search ..... 239/128, 132, 133, 135; 123/549, 556, 557, 555, 298, 145.5, 179 H

[56] References Cited

U.S. PATENT DOCUMENTS

| | | | |
|---|---|---|---|
| 1,065,580 | 6/1913 | Beucus | 123/549 X |
| 1,466,248 | 8/1923 | Reed et al. | 123/549 X |
| 1,693,931 | 12/1928 | Lowe . | |
| 1,780,499 | 11/1930 | Novelli | 123/298 |
| 2,066,860 | 1/1937 | Shumake | 239/123 X |
| 2,198,850 | 4/1940 | White | 123/145 A |
| 2,628,600 | 2/1953 | Malin | 123/298 |
| 3,373,724 | 3/1968 | Papst | 123/145 R X |
| 3,373,727 | 3/1968 | Papst | 123/298 |
| 3,402,704 | 9/1968 | Wetzky et al. | 123/145 A X |
| 3,566,850 | 3/1971 | Busch | 123/145 A |
| 3,866,587 | 2/1975 | Knapp | 123/549 |
| 3,868,939 | 3/1975 | Friese et al. | 123/549 X |
| 4,086,893 | 5/1978 | Bernbecker | 123/549 |
| 4,108,953 | 8/1978 | Rocco | 123/549 X |
| 4,300,154 | 11/1981 | Schaich | 123/557 |
| 4,372,260 | 2/1983 | Baker | 123/557 X |
| 4,418,661 | 12/1983 | Esper et al. | 123/145 A |
| 4,458,654 | 7/1984 | Tuckey | 123/557 |
| 4,458,655 | 7/1984 | Oza | 123/557 X |

FOREIGN PATENT DOCUMENTS

| | | | |
|---|---|---|---|
| 558843 | 8/1932 | Fed. Rep. of Germany . | |
| 834467 | 7/1949 | Fed. Rep. of Germany . | |
| 2750080 | 5/1979 | Fed. Rep. of Germany | 123/557 |
| 3010591 | 10/1980 | Fed. Rep. of Germany . | |
| 2405375 | 7/1978 | France . | |
| 131822 | 8/1982 | Japan | 123/557 |
| 774948 | 5/1957 | United Kingdom . | |
| 2084649 | 4/1982 | United Kingdom . | |

OTHER PUBLICATIONS

European Patent Office, #102507, Inventor Inhof et al, Assignee Bosch.

*Primary Examiner*—Joseph F. Peters, Jr.
*Assistant Examiner*—Kevin Patrick Weldon
*Attorney, Agent, or Firm*—Edwin E. Greigg

[57] ABSTRACT

An apparatus for injecting fuel into combustion chambers, in particular of self-igniting internal combustion engines, is proposed, in which a fuel injection nozzle generates an aimed fuel spray and in which an air guide device and a heating device are provided. The fuel being injected is accompanied by an air flow which passes the heating device. The heating device has at least two heating elements of different effectiveness, of which at least one element serves for rapid heating and the other element is provided for continuous use.

24 Claims, 12 Drawing Figures

APPARATUS FOR INJECTING FUEL INTO COMBUSTION CHAMBERS

STATE OF THE ART

The invention is based on the apparatus for injecting fuel into combustion chambers as generically defined hereinafter. In a known apparatus of this type (French Pat. No. 1 382 697), the fuel is conducted through a tubular heating device shortly before or after injection, in order thereby to maintain a temperature facilitating ignition. One disadvantage in this known apparatus is that heating of the fuel occurs before the fuel meets the combustion air, and another is that the virtually divergent conditions for cold-start heating and for constant heating during operation must be satisfied with merely a single heating element. When fuel alone is heated, it is absolutely necessary that the heating temperature not be too high, so as not to cause decomposition of the fuel in the absence of combustion air and subsequent carbonization, or even carbonization in the vicinity of the first air inlet—that is, at the injection port—because of the sudden availability of combustion air, which can cause a change in the injection port and in every case has extraordinarily disadvantageous effects on the course of combustion in the combustion chamber. The quantity of fuel to be injected is a function of the pressure and the cross section, and it is metered in accordance with a predetermined quantity of combustion air in the combustion chamber. As soon as changes in the predetermined fuel/air ratio occur as a consequence of changes in the cross section of the injection port, this has a direct effect on the quantity of combustion; that is, the fuel/air mixture is either too lean or too rich.

Heating the fuel prior to its emerging from the fuel injection nozzle results in a change in volume even before its passing through the injection port, so that fewer units of heat are available per unit of volume in the heated and therefore expanded fuel than is the case with a cold fuel, which has a smaller volume.

A further disadvantage of this known system is that warm fuel is injected into cold air, which is substantially poorer in terms of homogenizing a fuel/air mixture than is the case when cold fuel is injected into warm air. In the latter case, the fuel is gasified by being heated and is capable of mixing intimately with the air. In the first case, contrarily, the possibly pre-gasified fuel particles condense again and are drawn together by liquid adhesion, thereby losing their force, so they no longer travel deep into the combustion chamber. As a result, the mixture formation is poorer in quality, because not all the charge of fresh air takes part in the mixture formation and combustion process.

These disadvantages have a particularly pronounced effect if the heating is intended to take place intermittently and/or to a variable extent. For the internal combustion engine, the fuel/air mixture is adjusted at a predetermined ratio, and in this known system this ratio becomes inaccurate, depending on the degree and duration of heating. The other substantial disadvantage of this known system is that on the one hand, such a system must briefly and effectively produce a high heat output during starting and when the combustion chamber is cold, which output must then be shut off after the combustion chamber (that is, the engine) has warmed up. To this end, the heating device must have a high wattage and relatively large heating surfaces. The other demand also made of such a heating device is quite different, when it is additionally intended to improve combustion during continuous operation. This may be necessary at very low ambient temperatures, for example, but it may also be provided in the field of oil burning, to generate a blue flame.

In contrast to the cold-start heating device, a heating device for continuous operation should have the lowest possible wattage or power and should have a heat-storing effect. The demand for the smallest possible power consumption is primarily based on energy consumption but secondarily on the energy-dependent wear as well. A storage effect is particularly desirable in internal combustion engines in which the fuel is injected intermittently and the heat dissipation is accordingly intermittent as well. Thus in the intervals for heat dissipation, a reheating of the cooled element may occur. Additionally, in an internal combustion engine, heating and cooling phases may alternate in rapid succession, depending on the power produced by the engine itself, and in that case heat storage is advantageous.

Other devices of this generic type are also known, for instance glow plugs or pins which are built into the combustion chamber. In the vicinity of their tips, they create favorable conditions for heating, vaporizing and igniting a partial quantity of the fuel, which then ingites the entire fuel spray.

However, glow plugs and pins are separate parts, and installing them in combustion chambers means an intervention into sensitive flow conditions. The trend toward alternative fuels such as alcohols and vegetable oils, which has been reinforced by the energy shortage, presents further difficulties in terms of mixture formation and ignition in the field of fuel injection.

An apparatus of the type mentioned at the outset herein is also known (German Patent Disclosure Document DE-OS No. 27 15 943) in which the fuel injection nozzle is followed by a mixing chamber having an ignition device; combustion is initiated in this chamber, and its chamber walls are heated. The mixing chamber is formed in a sleeve which is screwed into the combustion chamber wall and also bears the injection nozzle. Aside from the fact that this apparatus is relatively expensive and must be carefully matched in various respects to the fuel to be used and to the particular engine conditions involved, here again the disadvantage arises that because of the restricted conditions, either cold-start heating or continuous heating is possible. Furthermore, the inflow and outflow losses in this apparatus have the effect of reducing power.

ADVANTAGES OF THE INVENTION

The apparatus according to the invention has the advantage over the prior art that with very simple means, it makes it possible to obtain either heating during starting or continuous heating, or both. In addition to the at least two heating elements having different effects, it is important for this invention that it is substantially the combustion air which, in the form of a flow, accompanies the fuel being injected that is heated. As a result, because of the substantially lower flow speed than the fuel stream, the hot combustion air is capable of mixing the fuel intensively and substantially homogeneously with the combustion air by tearing apart the fuel spray because of physical resistance on the one hand and thermal expansion on the other. This mixing naturally results in an equalization of temperature between the fuel and the air, which is an optimal precondition for a favorable ignition behavior. A very important fact here is that only the peripheral zone of the fuel spray, having from 5 to 20% of the full-load quantity, takes part in the processes described. The heating energy consumed is reduced considerably thereby.

Furthermore, all the above-named disadvantages of heating the fuel prior to its emergence from the injection port, which make it virtually impossible to establish an optimal combustion subject to varying loads, are avoided. The use of heating elements of different effects has the advantage that at least one heating element for the starting output—that is, a high heat yield in a brief time—and another heating element for continuous operation—that is, a lesser output over a long period—can be combined with one another. Since the combustion air is primarily heated via a convective yield of heat from the heating element, the particular heating element can be disposed in accordance with the invention such that sufficiently much combustion air comes into contact with a correspondingly sufficient heating surface area. It is now possible in accordance with the invention for a very large heating surface to serve for startup heating and a correspondingly small heating surface to serve for the continuous heating, the large heating surface being for instance taken out of action after starting while the small heating surface remains continuously in operation.

For the different effectiveness, however, a different heating temperature can also suffice in accordance with the invention, specifically, for example with surface areas of equal size, by providing a glow temperature for the cold-start heating and a lower temperature for the continuous heating. The cold-start heating almost always has a greater power consumption, but only for a short time.

According to an advantageous embodiment of the invention, a plurality of heating elements can be connected such that they are electrically parallel but are in series in terms of the flow direction. Because of the parallel electrical connection, alternative switching on and off is possible, with the air that is to be heated being required to travel past all the heating elements. The order of the heating elements is selected in accordance with heating system engineering requirements. According to one embodiment of the invention, a rapid-heating element may come first in the flow direction, followed by a continuous-heating element and then another rapid-heating element.

It is also conceivable here that one of the rapid-heating elements be used for normal cold starting, while contrarily both heating elements are used when it is particularly cold or when other starting problems arise. Thus it is also conceivable that a portion of the heating elements be exposed to the flow of combustion air before that flow meets the fuel spray, and that a further portion of the heating elements be provided downstream of where the fuel enters.

Any conceivably suitable means, such as hot wires, may be used as the heating element itself. While hot conductors have advantages especially when there are large surface areas available which are passed over by the combustion air, there are particular advantages in the use of hot wires, embodied as heating coils which are surrounded by the flow of combustion air and in which the center of the coil may possibly have the fuel spray passing through it. Here again, a plurality of such coils can be disposed in series, or else different elements, such as hot conductors and coils, can be exposed in succession to the combustion air.

According to an advantageous embodiment of the invention, a plurality of heating elements can be connected in series both electrically and in terms of the flow direction. By the appropriate design both of the surfaces yielding heat and of the switching elements, a variable heat yield, depending on requirements, can be produced even in the case of a series circuit. For instance, in this series circuit the heating element for cold starting can be automatically switched on when the combustion air aspirated is cold, and it can then be off when the engine is warm. It is also conceivable for a continuous heating element to begin operation only after a cold-start heating element has already been switched off.

According to a more elaborate embodiment of the invention, the heating element is disposed on a ceramic body which absorbs heat and has a certain storage effect. The heating element here can be embodied as a sintered-in a layer of metal or as a heating coil, which is exposed more or less to the air flow so that part of the heat is given up directly to the air but another part is given up to the ceramic body, which because of the thermal storage capacity imparted to it returns part of the heat back to the heating element during the injection periods, producing a temperature-balancing effect.

In devices in which the glow attachment has a ceramic support body, a simple realization is attained if the support body comprises electrically conductive material and itself forms a heating element, preferably the continuous-heating element intended for constant operation.

As a result, a metal heating element can be dispensed with, and furthermore, without additional expense, a heating element resistant to high temperatures and combustion gas is attained, one which is not sensitive to temperature shock and is suitable for both brief heating times and continuous glow operation.

The ceramic support body can preferably comprise a ceramic material having a negative temperature coefficient (NTC resistor), preferably SiC. If it is appropriately matched to the metal heating element, however, the ceramic support body could also comprise a material having a positive temperature coefficient (PTC resistor), such as $MoSi_2$. The materials indicated are particularly resistant to thermal shock and can be used in both a reducing and an oxidizing atmosphere up to high temperatures (SiC up to approximately 1150° C., $MoSi_2$ up to approximately 1300° C.).

According to a further proposal of the invention, the metal heating element can comprise a material having a positive temperature coefficient (PTC resistor), preferably a platinum alloy. A heating element of this type can be combined with the ceramic glow body, as a second heating element, to make a rapid-response continuous glow element. The metal heating element attains glow heat within a short time during the process of preliminary glowing and starting the engine and thereby not only provides the high starting power but also heats the ceramic support body to the point that it becomes conductive and then heats itself further by means of its own consumption of current. The current load on the metal heating element embodied as a PTC resistor thereby returns to lower values, thereby enabling continuous operation of the metal heating element as well, without damage. The successive activation of the two heating elements is attained without additional switching means, and the ceramic support body embodied as a self-heating glow body is furthermore particularly well suited for forming conduits through which the combustion air accompanying the ejected fuel is guided.

The cooperation of the metal heating element with the ceramic support body can be varied in a specified way if the metal heating element has a highly heat-conductive contact with the support body over at least portions of its length.

As a result, it is for instance possible for the sections of the metal heating element that are in heat-conductive contact with the support body to heat up more slowly than the other portions of the line during the starting phase of the engine and therefore remain for a longer period in a lower resistance range. The sections of the metal heating element that heat up more rapidly or the a higher temperature can in this case be disposed in that region of the glow attachment in which the accompanying combustion air has already mixed with the peripheral zones of the fuel spray.

A particularly effective disposition results if the support body has a central bore for the passage of the fuel and the metal heating element is provided with at least one, but preferably a plurality of coil sections disposed on the bore wall of the support body.

In this disposition, not only a very good heat transition is attained, but also the coil section or sections of the metal heating element disposed on the bore wall of the support body additionally serve to assure good turbulence or mixing of the accompanying combustion air with the peripheral zones of the fuel stream.

In a preferred structural embodiment, it is provided that the flow of combustion air accompanying the fuel being injected be guided by the air guide device over the outer jacket of the support body before entry into its central bore and that the line sections of the metal heating element joining the inner coil sections be guided over the outer jacket or by depressions in the support body that begin at the outer jacket. As a result, the accompanying combustion air is pre-heated well, even before it contacts or mixes with the fuel being injected.

In a preferred embodiment of this type, it is particularly advantageous if the line sections of the metal heating element joining the inner coil sections likewise are embodied as coils, which are fitted into slits extending radially from the jacket circumference of the support body almost to the central bore wall thereof.

The length of the coil sections of the metal heating element that are disposed in the slits of the support body may be approximately 50% of the total length thereof. During the pre-glowing and starting phase of the engine, the inner coil sections of the metal heating element that are located in the central bore of the support body attain a glow heat in the temperature range of approximately 1200° to 1400° C. within 1 to 2 seconds. The other coil secctions fitted into the slits of the support body, having a more intensively heat-conductive contact with the support body, exhibit a substantially slower rise in temperature. The PTC effect of the metal heating element now causes the high temperature of the inner coil sections facing the injection spray, which is important for the starting phase, to decrease to the extent that the increase in resistance of the coil sections in the support body slits, which are slower to heat up, takes priority. Thus as a result of this self-controlling effect the high heating element temperature, which is important for the starting phase, returns to a value which no longer shortens the service life of the metal heating element. At the same time, the temperature of the support body increases further, being heated by the metal heating element, until its resistance has dropped to such an extent that the support body itself becomes a hot conductor when voltage is applied.

It is of no importance to the invention whether the fuel injection nozzle involved is one having only a single injection port, such as a pintle nozzle or a nozzle that opens outward, or a multi-hole nozzle.

BRIEF DESCRIPTION OF THE DRAWINGS

Four exemplary embodiments of the subject of the invention are shown in the drawing and explained in further detail below.

Shown are.

DESCRIPTION OF THE EXEMPLARY EMBODIMENTS

Figure 1:
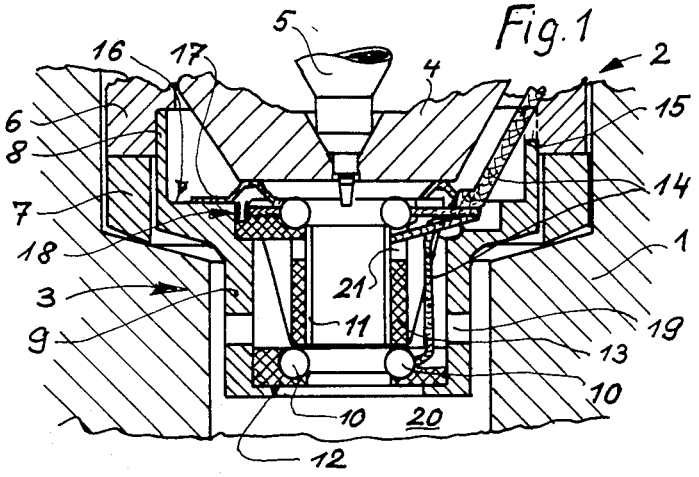
FIG. 1, the first exemplary embodiment, in which one continuous-heating element is disposed between two rapid-heating elements.

In the exemplary embodiment shown in FIG. 1, a fuel injection nozzle 2 on which a heating device 3 is disposed is inserted into an engine block 1. The fuel injection nozzle 2 has a nozzle body 4 and a valve needle 5 operating therein as well as a nozzle clamping nut 6, which which the nozzle body 4 is clamped to a nozzle holder, not shown, and which with its one end face acts upon a spacer ring 7 disposed between the engine housing 1 and the fuel injection nozzle 2.

A housing 9 of a heating device which has two rapid-heating elements 10 and a continuous-heating element 11 is inserted into a recess 8 of the nozzle clamping nut 6. The heating elements 10 and 11 are supported by ceramic bodies 12 and 13, which are disposed in the housing 9 of the heating device 3. Electric lines 14 which are laid in a milled recess 15 of the nozzle clamping nut 6 lead to the heating elements.

On a step 16 of the inner bore of the housing 9, resilient holder plates 17 are provided, with which on the one hand the heating elements 10 and 11 as well as the ceramic parts 12 and 13 are retained in their installed position and on the other hand a definite distance from the nozzle body 4 is established. A bimetallic switch 18 controls the electrical connection with the rapid-heating element. As soon as a sufficient ambient temperature is attained, the bimetallic switch opens and the rapid-heating stage is shut off.

Radial openings 19 are provided in the housing 9, by way of which the combustion air travels from the combustion chamber 20 of the internal combustion engine into the housing 9 of the heating device. The fuel spray passing through the inside of the heating elements acts like a water jet pump and via further radial openings 21 draws the combustion air in via the radial openings 19, so that a sort of circulation of the combustion air takes place from the combustion chamber 20 back to the combustion chamber 20, in the course of which this combustion air touches the heating elements as it moves past them.

Because of this embodiment, a multi-stage heating device is attainable with the simplest possible means.

Figure 2:
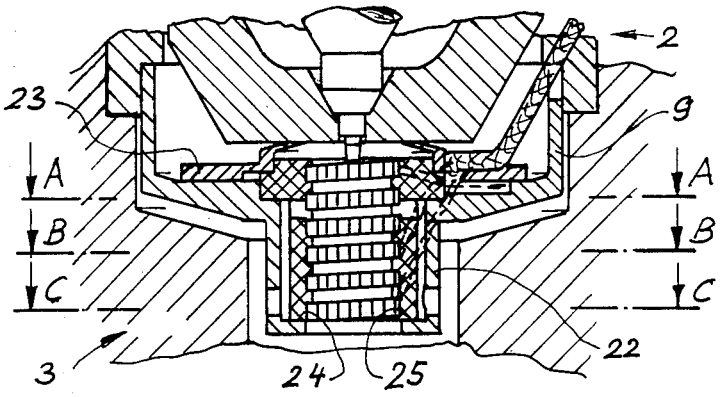
FIG. 2, the second exemplary embodiment, having a heating coil comprising three parts.

In the second exemplary embodiment shown in FIG. 2, the design of the fuel injection nozzle 2 and the heating device 3 is the same in principle as in the first exemplary embodiment. The difference is that the ceramic part disposed in the housing 9 of the heating device is embodied as a sleeve 22, which is retained in its position via a spring plate ring 23 and the inner bore of which has helical grooves 24, in which the heating elements, comprising helically extending hot wires 25, are disposed. The hot wires have a flat, rectangular cross section, so as thereby to have the largest possible surface area that can be contacted by the moving air. In order to grasp these hot wires better during assembly, the ceramic sleeve 22 comprises two half shells.

Figure 3:
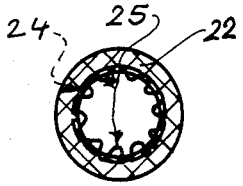
FIG. 3, a section taken along the line A—A of FIG. 2.

The band-like heating coil itself is furthermore corrugated, in order to optimally enlarge the surface area. Three heating elements are disposed in series in the flow direction in this sleeve 22. As shown in FIG. 3, the coil closest to the nozzle body, shown in the cross section A—A of FIG. 2, is the most tightly corrugated. The spacing between the individual corrugations is quite close, and a considerable portion of the heating element disappears into the groove 24 of the ceramic part 22. Thus it projects only to a relatively small distance into the flow of combustion air, and only a relatively slow heating process accordingly takes place. Since on the other hand a substantial portion of this coil rests in the ceramic area, the ceramic area here is relatively greatly heated and has a heat-storing effect.

Figure 4:
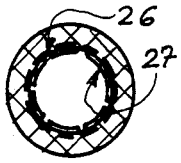
FIG. 4, a section taken along the line B—B of FIG. 2.

In FIG. 4, a section is shown taken along the line B—B of FIG. 2, in which a second heating element of the heating coil is shown which is corrugated less tightly and rests to a lesser extent in the ceramic area. While in this case the coil is now supported in the helical groove of the ceramic body only via seven protrusions 26, the heating coils 27 which are located between those protrusions 26 and are exposed directly to the air flow effect a considerable direct increase in the heating surface area. Thus with this middle heating element, a corresponding average heating speed is attainable.

Figure 5:
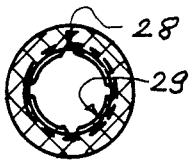
FIG. 5, a section taken along the line C—C of FIG. 2.

In FIG. 5, in which a section taken along the line C—C of FIG. 2 is shown, the heating coil now rests only on four protrusions 28, so that the sections 29 located between them present virtually a maximum of heating surface area. This coil section is provided for rapid heating, or in other words for cold starting.

Aside from the basic form shown in FIGS. 3–5, these heating bands may also have varying widths. For instance, it may be necessary, in order to attain the desired heating effect, to enlarge the surface area for the startup heating process by widening the band.

Figure 6:
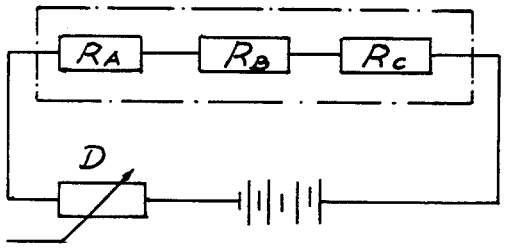
FIG. 6, a circuit diagram, in which the three hot resistors are connected in series.

In FIG. 6 a circuit diagram is shown such as it might appear for the second exemplary embodiment. The resistors indicated as $R_A$, $R_B$, $R_C$ correspond to the heating elements in the vicinity of the sections A—A, B—B, C—C. The three resistors are connected in series and are preceded by a variable resistor D. Because of the fixed embodiment of the heating elements, the proportions of the heating elements are in principle already fixed, and their total output is variable via the variable resistor.

Figure 7:
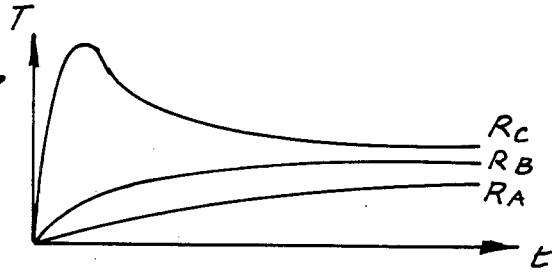
FIG. 7, a diagram in which the temperature is plotted over the time.

From the diagram in FIG. 7, in which the temperature (ordinate) is plotted over the time (abscissa), it can be see what effect the individual resistors have over time. The resistor $R_C$, particularly, initially has a very high temperature output, which then drops to an average value, which some time later is also attained by the other two resistors $R_B$ and $R_A$. Thus by means of this structural embodiment of the heating element, at the beginning of the heating process a sharp differentiation is attained in the direction of rapid heating by the resistor C, until after some time the resistor power yield of all three heating elements is approximately equal.

Figure 8:
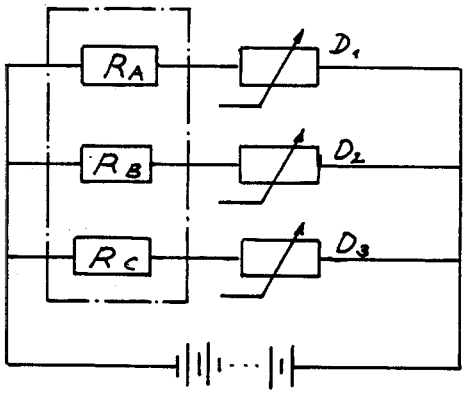
FIG. 8, a circuit diagram in which the three hot resistors are connected in parallel.

In FIG. 8, a circuit diagram is shown in which the resistors $R_A$, $R_B$ and $R_C$ are disposed in parallel, and variable resistors $D_1$, $D_2$ and $D_3$ are each associated in order with one of them. A circuit may instead be effected via integrated semiconductors as well.

Figure 9:
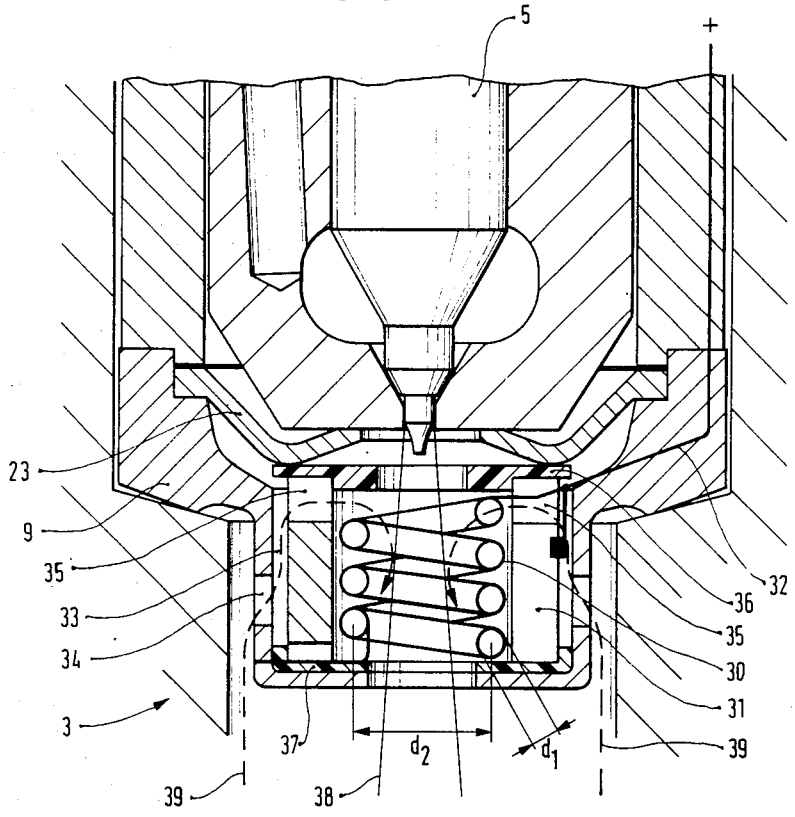
In FIG. 9 the third exemplary embodiment and in FIG. 10 the fourth exemplary embodiment are shown, each in a fragmentary section.

The exemplary embodiment of FIG. 9 also has the same basic design as the above-described embodiments so that here again only the structural differences need to be described in detail. The heating device 3 has an inner metal heating element 30, which is formed of a glow wire which is coiled both about its longitudinal axis with a diameter $d_1$ and about the axis of the injection nozzle with a diameter $d_2$ and comprises a material having a positive temperature coefficient. The diameter of the material making up the glow wire is matched to the coil diameters $d_1$ and $d_2$ such that an inherently rigid body is the result, one which is resistant to the forces of deformation arising during operation.

The heating element 30 is surrounded with little play by an annular support body 31, which comprises electrically conductive ceramic material with a negative temperature coefficient and embodies a second heating element. To this end, the support body 31 is slit lengthwise at one point of its circumference and bonded at one flank of the slit to an electric conductor 32, to which the end of the heating element 30 is also connected. Between the support body 31 and the housing 9, an annular chamber 33 is formed, which communicates via bores 34 in the housing 9 with the combustion chamber of the engine and via peripheral notches 35 in the support body 31 with the support body interior.

The two heating elements 30 and 31 are firmly held centrally on the housing 9 via the spring plate ring 23 also provided here and via a perforated screen 36 made of electrically insulating material. The perforated screen 36 also protects the injection nozzle 5 from infrared radiation as well as shielding the peripheral notches 35 in the support body 31 from the injection nozzle. Between the support body 31 and the inwardly pointing rim of the housing 9, an intermediate plate 37 is provided, which is likewise comprised of electrically insulating material. The two connections of the heating element 30 and support body 31 which are not connected to the conductor 32 are connected to the housing 9, which serves as a ground connection.

When the engine is put into operation, both heating elements 30 and 31 are connected to voltage in parallel. The metal heating element 30 subsequently attains glow heat very rapidly, while the ceramic heating element 31 begins to heat up only very slowly. After a certain period of operation, the ceramic heating element 31 has attained its continuous-glow temperature, while the heating element 30, because of its increasing resistance, has a lesser electrical load than at first. As a result, the metal heating element 30 is not damaged during continuous operation. In this manner it is attained that the glow attachment initially produces a high heating output and then drops to an average heating output, which on the one hand is sufficient for operation and on the other hand does not damage the two heating elements. The fuel spray 38 ejected from the injection nozzle 5 aspirates combustion air from the combustion chamber along the flow lines 39; this combustion air has already been pre-heated on the outside of the ceramic support body 31 and in the interior of the support 31 it penetrates the peripheral zone of the fuel spray, where it mixes intensively with the fuel droplets in the peripheral zone.

Figure 10:
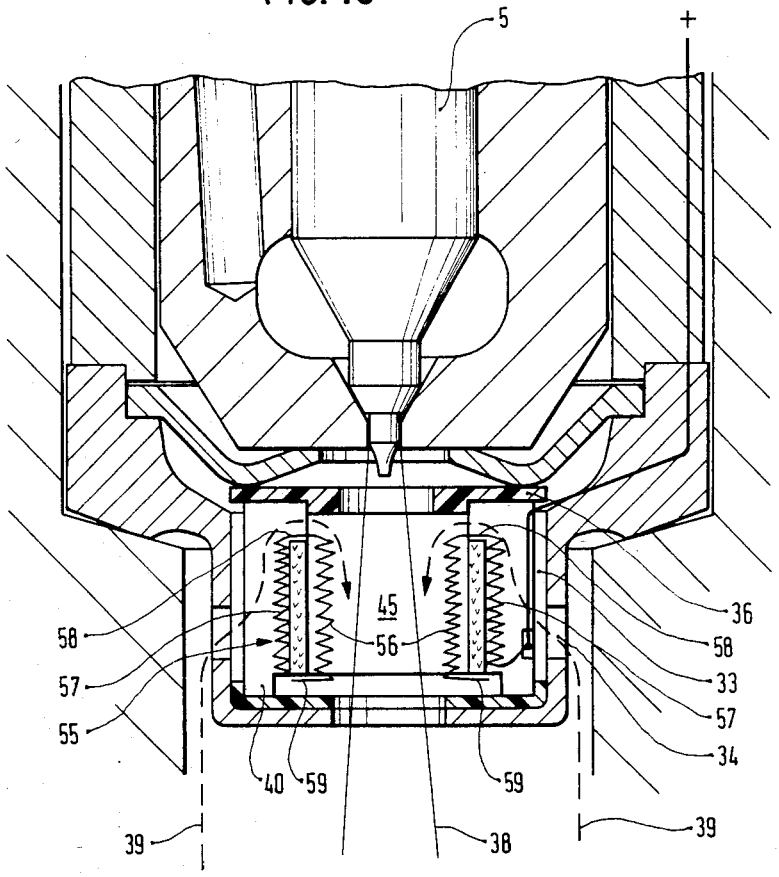
Figure 11:
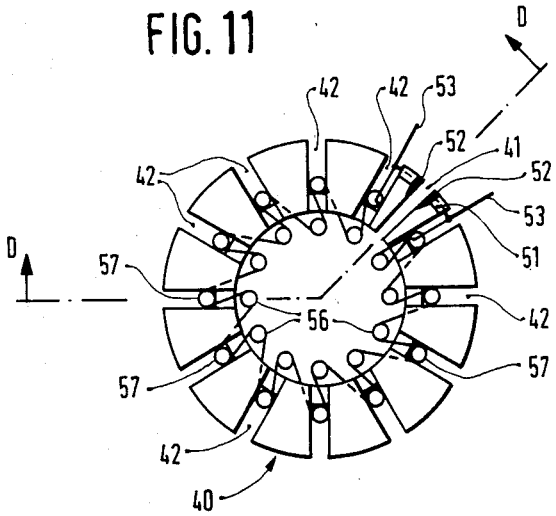
FIG. 11 shows a plan view on the glow body of FIG. 10.
Figure 12:
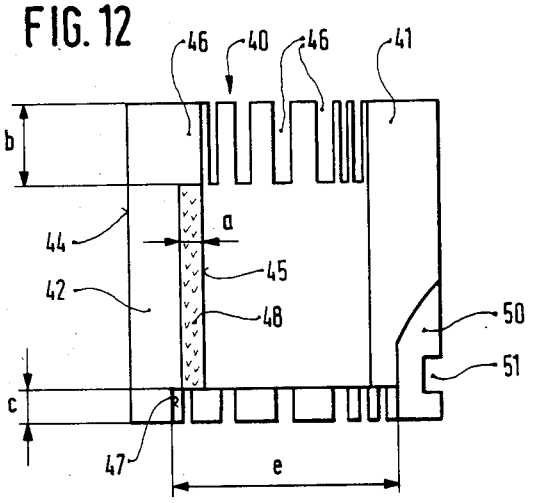
FIG. 12 is a section through the support body of the glow body of FIG. 11 taken along the line D—D of FIG. 11.

The embodiment of FIGS. 10–12 agrees with the embodiment of FIG. 9 except for a differently embodied glow attachment. The glow attachment has an annular ceramic support body 40, which at one point has a radial partitioning slit 41. The support body 40 is also provided with a multiplicity of uniformly distributed longitudinal slits 42, which begin at its jacket circumference 44 and extend as far as a distance a from its central bore 45. At the upper end of the support body 40, the longitudinal slits 42 are indented, for an axial length b, all the way to the central bore 45, so that there each forms a passage 46 through to the bore 45. At the lower end, the support body 4 is provided with a central recess 47 having a depth c and a diameter e. Between the passages 46 and the recess 47, a core ring 48 remains, which is interrupted only by the continuous partitioning slit 41.

The supporting body 40 is fabricated from an electrically conductive ceramic material which has an negative temperature coefficient and has a notable electrical conductivity only at elevated temperatures. The surfaces of the support body 40 defining the partitioning slit 41 are provided with local indentations 40, in the vicinity of each of which a groove 51 leading to the adjacent slit 42 discharges in the jacket circumference 44 of the support body 40. Contact elements 52 are disposed in the vicinity of the indentations 50, joining the support body 40 in an electrically conductive manner with connection wires 53 guided through the grooves 51.

On its entire surface, the support body 40 is coated with an electrically insulating layer, which is not identified specifically in the drawing. A metal heating element 55 is wound onto the support body 40, comprising a glow wire with a positive temperature coefficient. The heating element 55 has a number of inner coil sections 56 corresponding to the number of slits 42, each extending opposite a slit 42 along the wall of the bore 45 and spaced slightly apart therefrom. Associated with each inner coil section 56 is an outer coil section 57, which is inserted in a fitted manner into the corresponding slit 42 and is in good heat-conductive contact with the support body 40.

On the end facing the injection nozzle, the two radially opposed coil segments 56, 57 are joined via a straight glow wire section 58 disposed in the passage 46. On the opposite end, each outer coil section 57 is joined with an inner coil section 56 located in an adjacent plane of separation via a straight glow wire section 59.

As a result of the described embodiment of the support body 40, the core ring 48 thereof forms a hot resistor, curved into an open ring, which is connected parallel to the electric heating element 55 via the connection wires 53. Furthermore, because of the longitudinal slits 42, thermal stresses of the support body during operation are substantially avoided. The support body 40 is preferably fabricated of SiC, while the heating element 55 is of some material having a PTC characteristic, such as a platinum alloy or $MoSi_2$. The number of longitudinal slits 42 as well as the depth of the slits is determined by the diameter of the coil and by the length of wire of the heating element 55 to be accommodated, as well as by the desired support body resistance at a particular support body temperature.

During the pre-glowing and starting phase when starting the engine, the coil sections 56 of the heating element 55 located in the bore 45 heat up within 1 to 2 seconds, for example, to the temperature range from 1200° to 1400° C. The coil sections 56 thus act as a starting coil, which exhibits the very rapid temperature rise as a result of a high consumption of electrical current. The other coil sections 57 of the heating element 55, which are inserted into the longitudinal slits 42 and have a more intensive heat-conducting contact with the support body 40, exhibit a substantially slower temperature rise and remain in the low temperature range for longer. As a result, the starting coil effect of the inner coil sections 56 is reinforced still further. Engine starting takes place in this phase of the maximum temperature of a portion of the heating element 55.

The PTC effect of the heating element 55 now causes the high temperature of the inner coil sections 56, which is important for the starting phase, to drop to such an extent that the increase in resistance of the more slowly heating coil sections 57 in the longitudinal slits 42 takes priority. This self-controlling effect thus reduces the high heating power of the coil sections 56, which is important for the starting phase, to a value which no longer impairs the service life of the heating element 55. At the same time the temperature of the support body 40, which is also heated along with the heating element 55, increases. The electrical resistance of the NTC ceramic of the support body 40 decreases to such an extent that the support body itself, at the voltage applied, consumes current and becomes a hot conductor. The outer coil sections 57 intimately joined to the support body 40 and having a PTC character are heated intensively, which causes a further rise in the resistance of the heating element 55, so that the power component of the PTC circuit drops still further.

The support body 40, which has now become a heating element, takes on the task as an NTC heating circuit of aiding ignition for the ensuing phase of warming up the engine to operating temperature. This heating circuit can be shut off after the operating temperature has been attained, or being a sturdy heating element it can remain switched on for other tasks involved in improving the course of combustion in the engine.

In this embodiment as well, the combustion air aspirated from the combustion chamber by the fuel spray ejected from the injection nozzle is guided over the outer circumference and through the longitudinal slits of the support body 40 and is there heated very effectively in the desired manner. After its resistance has increased, the heating element 55 continues to operate in the "gentle" or low-stress, energy-saving mode.

In a modified embodiment, the ceramic support body 40 may be embodied without an electrically insulating coating, at least on its jacket. As a result, although when the support body 40 becomes conductive the windings of the outer coil sections 57 may perhaps be short-circuited, counteracting the PTC effect of the heating element 55, nevertheless this PTC effect can be matched to the other parameters in such a manner that it overcomes the short-circuiting effect and the desired overall result will take place after all.

The foregoing relates to a preferred exemplary embodiment of the invention, it being understood that other variants and embodiments thereof are possible within the spirit and scope of the invention, the latter being defined by the appended claims.

We claim:

1. An apparatus for heating and injecting fuel-air into combustion chambers of self-igniting internal combustion engines, having a fuel injection nozzle for periodically injecting at least one aimed fuel spray through a passage of a combination air guide device and heating device, characterized in that the fuel being injected is accompanied by a flow of combustion air which is guided past the heating device and subsequently aspirated into said passage, said heating device further including at least two heating elements of different effectiveness, at least one of said heating elements is a rapid-heating element for rapid heating the air prior to being aspirated for operating said internal combustion engine in a cold state and at least one continuous-heating element for use during constant operation.

2. An apparatus as defined by claim 1, characterized in that the rapid-heating element has a higher outside temperature than the continuous-heating element.

3. An apparatus as defined by claim 1, characterized in that the continuous-heating element has a larger heating surface area than the rapid-heating element.

4. An apparatus as defined by claim 1, characterized in that the heating elements are disposed on a housing of the heating device, said housing being secured to the injection nozzle, and further that said housing serves as said air guide device.

5. An apparatus as defined by claim 4, characterized in that said housing includes means defining openings and further that the fuel spray generates an injector effect for the combustion air, which is aspirated from the combustion chamber via said openings in said housing and recirculated together with the fuel spray, back into the combustion chamber.

6. An apparatus as defined by claim 1, characterized in that the heating elements comprise a supporting part and a hot wire.

7. An apparatus as define by claim 6, characterized in that the supporting part comprises ceramic material.

8. An apparatus as defined by claim 6, characterized in that the hot wire comprises a helix and further that the supporting part includes a sleeve having a helical groove in which said helix is disposed.

9. An apparatus as defined by claim 1, characterized in that at least one heating element comprises a flat corrugated wire of rectangular cross section.

10. An apparatus as defined by claim 6, characterized in that the hot wire in the rapid-heating element is embedded in the supporting part to a lesser depth than the continuous-heating element.

11. An apparatus as defined by claim 1, characterized in that the rapid-heating element is controllable via a bimetallic circuit.

12. An apparatus as defined by claim 1, characterized in that at least a portion of the heating elements are switchable via integrated semiconductors.

13. An apparatus as defined by claim 1, further including a ceramic support body for a metal heating element, characterized in that the ceramic body comprises electrically conductive material and further includes said continuous heating element for use during constant operation.

14. An apparatus as defined by claim 13, characterized in that the ceramic body comprises a material having a negative temperature coefficient, such as SiC.

15. An apparatus as defined by claim 13, characterized in that the metal heating element comprises a material having a positive temperature coefficient such as $MoSi_2$.

16. An apparatus as defined by claim 13, characterized in that said metal heating element has a predetermined length and further that at least a portion of said length has a good heat-conductive contact with the ceramic body.

17. An apparatus as defined by claim 13, characterized in that the ceramic body further includes a central bore for passage of fuel therethrough and the metal heating element is provided with a plurality of coil sections disposed in proximity to the bore.

18. An apparatus as defined by claim 17, characterized in that the air guide device directs the flow of combustion air over the outer jacket of the ceramic body prior to its entry into the central bore thereof and further that the metal heating element includes line sections which join the coil sections, the line sections further arranged to be guided over the outer jacket.

19. An apparatus as defined by claim 18, characterized in that the line sections of the metal heating element which join the coil sections comprise helical coils and further that the ceramic body includes radially extending slits into which the helical coils are fitted.

20. An apparatus as defined by claim 18, characterized in that the outer jacket further includes indentations which are arranged to receive the line sections.

21. An apparatus as defined by claim 14, characterized in that the ceramic body is silicon carbide.

22. An apparatus as defined by claim 15, characterized in that the metal heating element is a platinum alloy.

23. An apparatus for injecting fuel into combustion chambers of self-igniting internal combustion engines, having a fuel injection nozzle for periodically injecting at least one aimed fuel spray, an air guide device and a heating device for heating the fuel being injected, characterized in that the fuel being injected is accompanied by a flow of combustion air which is guided past the heating device, said heating device including a plurality of heating elements connectable electrically in parallel and in series in terms of the air flow direction, at least one of said plurality of heating elements is a rapid-heating element for heating said internal combustion engine when in a cold state, and at least one continuous-heating element for use during continuous heating operation.

24. An apparatus for injectinag fuel into combustion chambers of self-igniting internal combustion engines, having a fuel injection nozzle for periodically injecting at least one aimed fuel spray, an air guide device and a heating device for heating the fuel being injected, characterized in that the fuel being injected is accompanied by a flow of combustion air which is guided past the heating device, said heating device including a plurality of heating elements at least one of said plurality of heating elements is a rapid heating element for heating said internal combustion engine when in a cold state, at least one continuous heating element for use during continuous heating operation and said plurality of heating elements are connectable in series electrically and in series in terms of the air flow direction.

* * * * *